US011614092B2

(12) United States Patent
Colson et al.

(10) Patent No.: US 11,614,092 B2
(45) Date of Patent: Mar. 28, 2023

(54) VENTILATION FAN HAVING A HYBRID BEARING SYSTEM

(71) Applicant: Hamilton Sundstrand Corporation, Charlotte, NC (US)

(72) Inventors: Darryl A. Colson, West Suffield, CT (US); Murtuza Lokhandwalla, South Windsor, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 188 days.

(21) Appl. No.: 16/944,769

(22) Filed: Jul. 31, 2020

(65) Prior Publication Data

US 2020/0362874 A1 Nov. 19, 2020

Related U.S. Application Data

(62) Division of application No. 15/258,402, filed on Sep. 7, 2016, now Pat. No. 10,876,539.

(51) Int. Cl.

| | |
|---|---|
| ***F04D 25/08*** | (2006.01) |
| ***F04D 29/057*** | (2006.01) |
| ***F04D 29/051*** | (2006.01) |
| ***F04D 29/52*** | (2006.01) |
| ***F04D 29/32*** | (2006.01) |

(Continued)

(52) U.S. Cl.

CPC ..... *F04D 29/057* (2013.01); *F04D 25/08* (2013.01); *F04D 29/051* (2013.01); *F04D 29/059* (2013.01); *F04D 29/329* (2013.01); *F04D 29/522* (2013.01); *F04D 29/584* (2013.01)

(58) Field of Classification Search

CPC ..... F04D 29/047–0476; F04D 29/057; F04D 29/049; F04D 29/059; F04D 29/181; F04D 29/325; F04D 25/062; F04D 25/12; F04D 25/08; F04D 13/026; F04D 13/0633; F04D 19/00; F04D 19/002

See application file for complete search history.

(56) References Cited

U.S. PATENT DOCUMENTS

| | | | |
|---|---|---|---|
| 4,507,939 | A | 4/1985 | Weiland |
| 4,878,805 | A | 11/1989 | Hagshenas |
| 5,113,670 | A | 5/1992 | McAuliffe et al. |

(Continued)

FOREIGN PATENT DOCUMENTS

| | | | |
|---|---|---|---|
| CN | 1730959 | A | 2/2006 |
| JP | 2013256884 | A | 12/2013 |

OTHER PUBLICATIONS

European Search Report for European Application No. 17188731.8 dated Jan. 22, 2018, 8 pages.

(Continued)

*Primary Examiner* — Thomas Fink
(74) *Attorney, Agent, or Firm* — Cantor Colburn LLP

(57) ABSTRACT

A ventilation fan includes a shaft, a rotor, a motor housing, a bearing housing, and an air bearing. The shaft has a shaft body that extends between a first shaft end and a second shaft end. The shaft body defines a first port and a bore. The rotor is disposed about the shaft. The motor housing is disposed about the shaft and is axially spaced apart from the rotor. The bearing housing is disposed about the shaft. The air bearing is disposed proximate the second shaft end and is disposed between the bearing arm and the second shaft end.

3 Claims, 6 Drawing Sheets

(51) Int. Cl.
*F04D 29/58* (2006.01)
*F04D 29/059* (2006.01)

(56) References Cited

U.S. PATENT DOCUMENTS

| | | | | |
|---|---|---|---|---|
| 6,151,909 | A | 11/2000 | Carter et al. | |
| 7,342,332 | B2 | 3/2008 | McAuliffe et al. | |
| 7,394,175 | B2 | 7/2008 | McAuliffe et al. | |
| 7,402,020 | B2 | 7/2008 | Beers et al. | |
| 7,757,502 | B2 | 7/2010 | Merritt et al. | |
| 8,418,495 | B2 | 4/2013 | Merritt et al. | |
| 8,459,966 | B2 | 6/2013 | Hipsky et al. | |
| 8,496,533 | B2 | 7/2013 | Beers et al. | |
| 8,529,192 | B2 | 9/2013 | Beers et al. | |
| 8,622,620 | B2 | 1/2014 | Beers et al. | |
| 8,672,768 | B2 | 3/2014 | Colson et al. | |
| 8,734,017 | B1 | 5/2014 | Colson et al. | |
| 8,772,992 | B2 | 7/2014 | Lee et al. | |
| 8,784,048 | B2 | 7/2014 | Beers et al. | |
| 8,814,499 | B2 | 8/2014 | Kim | |
| 8,905,707 | B2 | 12/2014 | Colson et al. | |
| 9,062,712 | B1 | 6/2015 | Bruckner | |
| 9,638,199 | B2 | 5/2017 | Beers et al. | |
| 2006/0059941 | A1* | 3/2006 | Merritt | F02C 6/18 62/401 |
| 2006/0061221 | A1 | 3/2006 | McAuliffe et al. | |
| 2006/0061222 | A1 | 3/2006 | McAuliffe et al. | |
| 2008/0063334 | A1 | 3/2008 | Gillespie | |
| 2011/0243762 | A1 | 10/2011 | Daikoku et al. | |
| 2012/0014784 | A1* | 1/2012 | Hipsky | F04D 29/5806 415/177 |
| 2013/0101436 | A1 | 4/2013 | Colson et al. | |
| 2013/0129488 | A1 | 5/2013 | Agrawal et al. | |
| 2013/0280042 | A1 | 10/2013 | Beers et al. | |
| 2015/0037138 | A1 | 2/2015 | Beers et al. | |
| 2015/0104302 | A1 | 4/2015 | Colson et al. | |
| 2015/0308460 | A1 | 10/2015 | Lucic et al. | |
| 2018/0066666 | A1 | 3/2018 | Colson et al. | |
| 2018/0066670 | A1 | 3/2018 | Colson et al. | |
| 2019/0211834 | A1* | 7/2019 | Hasegawa | F25B 1/053 |

OTHER PUBLICATIONS

European Search Report for European Application No. 17189845.5 dated May 29, 2018, 11 pages.

Partial European Search Report for European Application No. 17189845.5 dated Feb. 26, 2018, 13 pages.

European Search Report; Application No. 20206177.6-1007; dated Mar. 15, 2021; 6 pages.

* cited by examiner

VENTILATION FAN HAVING A HYBRID BEARING SYSTEM

CROSS-REFERENCE TO RELATED APPLICATIONS

This application is a Division of U.S. Non-Provisional application Ser. No. 15/258,402 filed Sep. 7, 2016, the disclosure of which is incorporated herein by reference in its entirety.

BACKGROUND

Aircraft ventilation fans are used to move conditioned air to various locations of the aircraft such as the cockpit or cabin. The aircraft ventilation fans may use ball bearings to rotatably support rotating components.

Brief Description

According to embodiment of the present disclosure, a ventilation fan is provided. The ventilation fan includes a shaft, a rotor, a motor housing, a bearing housing, and an air bearing. The shaft has a shaft body that extends between a first shaft end and a second shaft end. The shaft body defines a first port and a bore. The rotor is disposed about the shaft. The motor housing is disposed about the shaft and is axially spaced apart from the rotor. The motor housing has a mounting portion, a housing extension that extends from the mounting portion, and a vane platform that extends from the housing extension. The bearing housing is disposed about the shaft. The bearing housing has a bearing arm, a bearing leg that extends from the bearing arm, and a bearing extension that extends from the bearing leg and is operatively connected to the housing extension. The air bearing is disposed proximate the second shaft end and is disposed between the bearing arm and the second shaft end.

According to another embodiment of the present disclosure, a ventilation fan is provided. The ventilation fan includes a shaft, a rotor, a motor housing, a first opening, and a bearing housing. The shaft has a shaft body that extends between a first shaft end and a second shaft end. The rotor has a rotor first portion that is disposed about the shaft and is disposed proximate the first shaft end. The rotor second portion extends from the rotor first portion. The rotor first portion defines a rotor port. The motor housing is disposed about the shaft and is axially spaced apart from the rotor. The motor housing has a housing arm, a housing leg that extends from the housing arm, a housing extension that extends from the housing leg, and a vane platform that extends from the housing extension. The housing extension defines a housing port. The first opening is defined between respective ends of the rotor second portion and the vane platform. The bearing housing is disposed about the shaft and is disposed proximate the second shaft end. The bearing housing has a bearing arm, a bearing leg that extends from the bearing arm, and a bearing extension that extends from the bearing leg and is operatively connected to the housing extension.

According to yet another embodiment of the present disclosure, a ventilation fan is provided. The ventilation fan includes a shaft, a rotor, a motor housing, a bearing housing, and an air bearing. The shaft has a shaft body that extends between a first shaft end and a second shaft end. The rotor has a rotor first portion and a rotor second portion. The rotor first portion is disposed about the shaft and is disposed proximate the first shaft end. The rotor first portion defines a rotor port. The rotor second portion extends from the rotor first portion. The motor housing is disposed about the shaft and is axially spaced apart from the rotor. The motor housing has a housing arm, a housing leg that extends from the housing arm, and a vane platform that extends from the housing leg. The vane platform defines a housing port. The bearing housing is disposed about the shaft and is disposed proximate the second shaft end. The bearing housing extends between the vane platform and a rotating element bearing that rotatably supports the second shaft end. The air bearing rotatably supports the first shaft end.

BRIEF DESCRIPTION OF THE DRAWINGS

The subject matter which is regarded as the present disclosure is particularly pointed out and distinctly claimed in the claims at the conclusion of the specification. The foregoing and other features, and advantages of the present disclosure are apparent from the following detailed description taken in conjunction with the accompanying drawings in which:

DETAILED DESCRIPTION

Referring now to the Figures, where the invention will be described with reference to specific embodiments, without limiting same, it is to be understood that the disclosed embodiments are merely illustrative and may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Aircraft may include a cockpit or cabin ventilation system. The cockpit or cabin ventilation system may be provided as part of a larger environmental control system. The environment control system is configured to receive ambient air, condition the ambient air, and provide the conditioned air to various systems such as the cockpit or cabin ventilation system.

Figure 1:
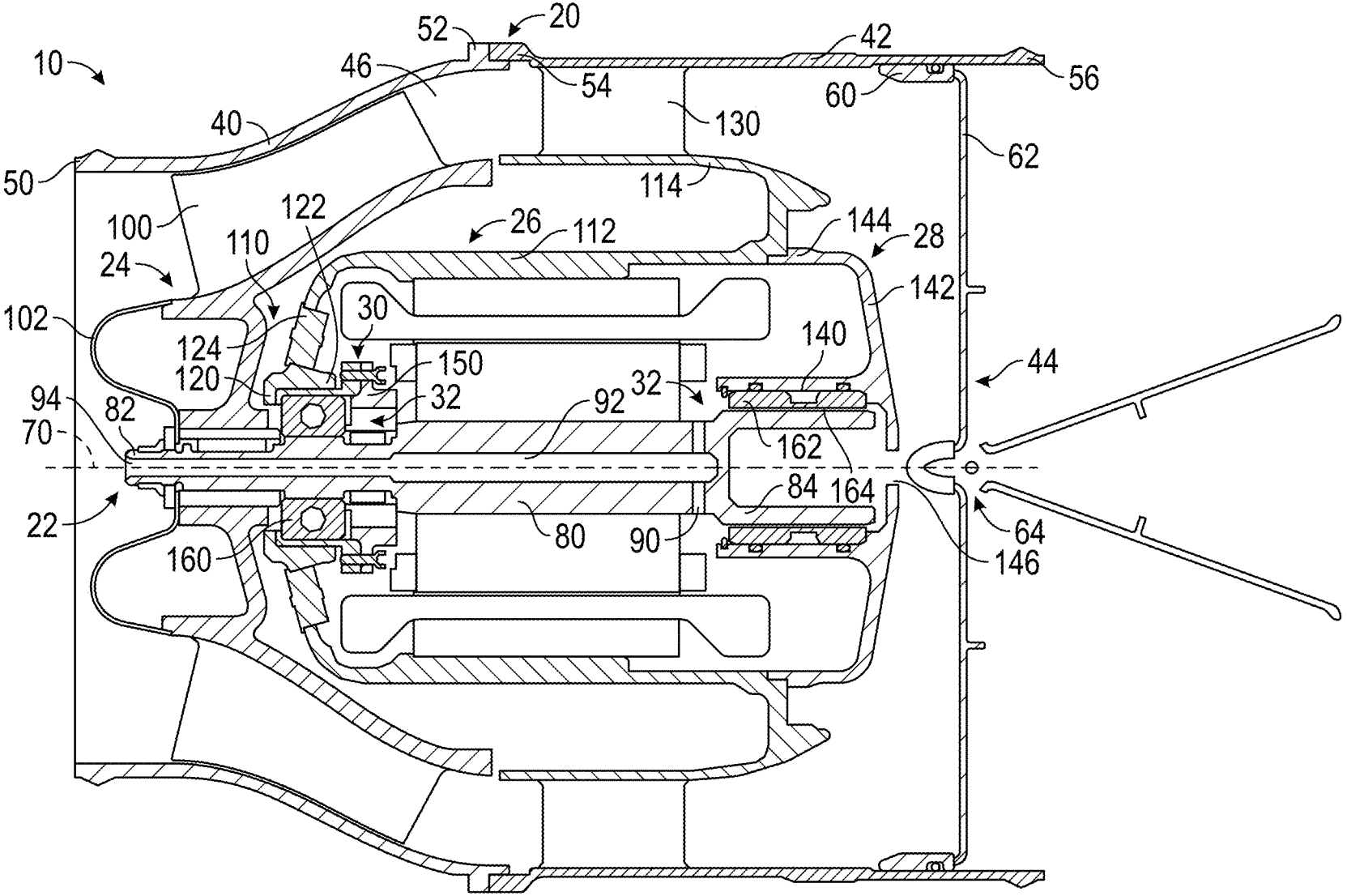
FIG. 1 is a sectional view of a first embodiment of a ventilation fan having a hybrid bearing system.
Figure 2:
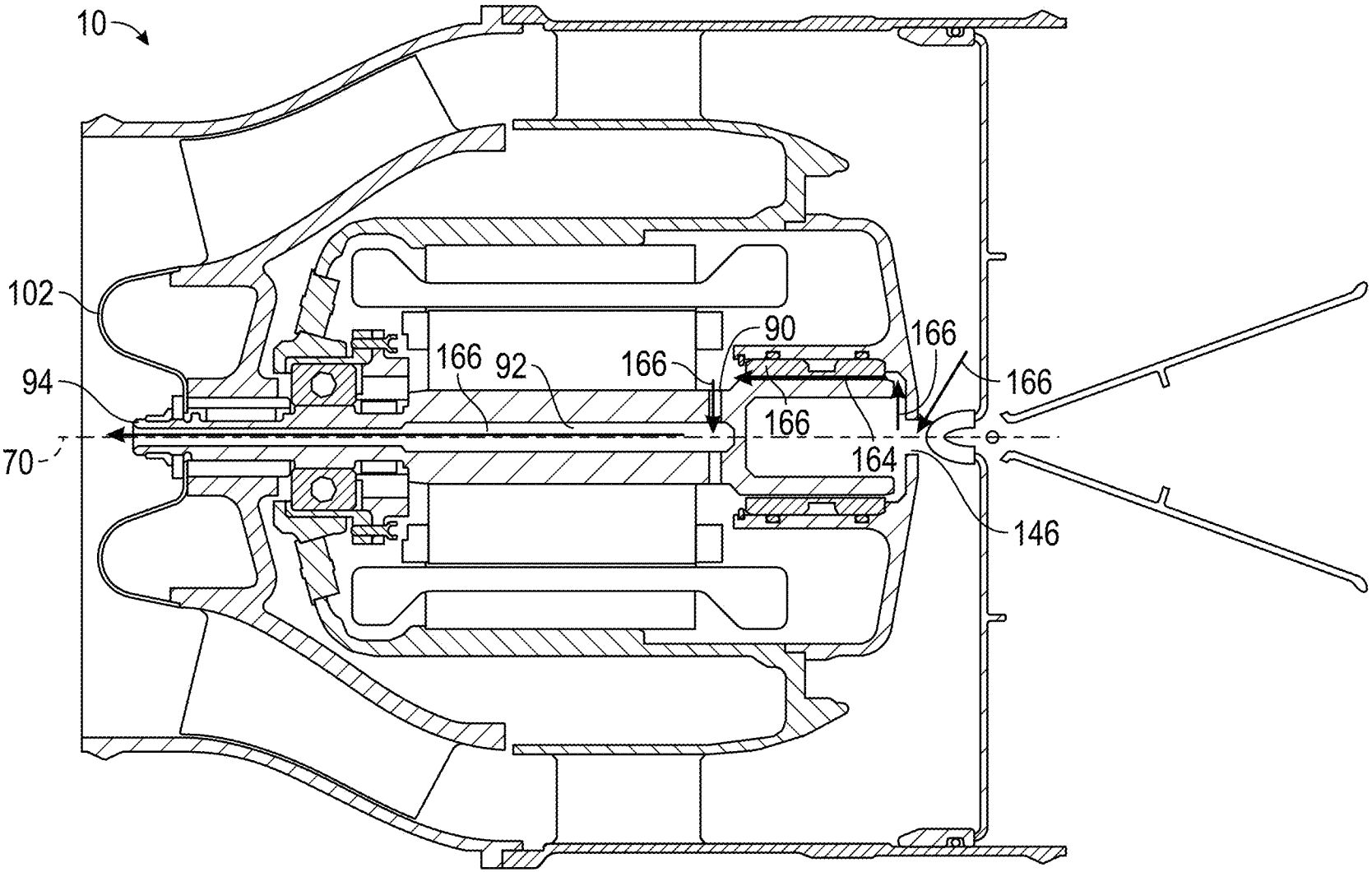
FIG. 2 is a sectional view of the first embodiment of the ventilation fan illustrating flow paths of the hybrid bearing system.

Referring to FIGS. 1 and 2, the conditioned air may be provided to the cockpit or cabin through a ventilation fan 10. The ventilation fan 10 includes a housing assembly 20, a shaft assembly 22, a rotor 24, a motor housing 26, a bearing housing 28, a thrust plate 30, and a hybrid bearing system 32.

The housing assembly 20 includes a first housing 40 that is operatively connected to a second housing 42 and a check valve assembly 44 that is operatively connected to the second housing 42. The first housing 40 and the second housing 42 cooperate to define a cavity 46 that may receive various components of the ventilation fan 10.

The first housing 40 defines a fan section inlet at a first end 50 of the first housing 40 and a fan section outlet at a second end 52 of the first housing 40. The first end 50 may have a first diameter and the second end 52 may have a second diameter that is greater than the first diameter.

The second housing 42 defines a rotor section inlet at a first end 54 of the second housing 42 and a rotor section outlet at a second end 56 of the second housing 42. The first end 54 may have a first diameter and the second end 56 may have a second diameter that is substantially equal to the first diameter. The first end 54 of the second housing 42 is operatively connected to the second end 52 of the first housing 40.

The check valve assembly 44 is disposed proximate the second end 56 of the second housing 42. The check valve assembly 44 includes a mounting frame 60, a valve plate 62, and a valve mechanism 64. The mounting frame 60 is disposed on an interior surface of the second housing 42. The valve plate 62 is operatively connected to the second housing 42 via the mounting frame 60. The valve plate 62 defines an opening that is configured to receive the valve mechanism 64. The valve mechanism 64 is configured as a one-way valve to inhibit backflow through the ventilation fan 10.

The shaft assembly 22 is disposed within the cavity 46 of the housing assembly 20. The shaft assembly 22 extends along an axis 70. The opening of the valve plate 62 is disposed about the axis 70.

The shaft assembly 22 includes a shaft body 80 extending between a first shaft end 82 and a second shaft end 84. The first shaft end 82 has a first shaft end diameter and the second shaft and 84 has a second shaft end diameter that is greater than the first shaft end diameter. In at least one embodiment, the shaft assembly 22 is configured as a segmented shaft having individual shaft portions that are joined together. The shaft body 80 defines a first port 90, a bore 92, and an exhaust port 94.

The first port 90 is disposed proximate the second shaft end 84. The first port 90 is disposed substantially perpendicular to the axis 70. The first port 90 extends into the bore 92.

The bore 92 extends from the first shaft end 82 towards the second shaft end 84 of the shaft body 80 along the axis 70. The bore 92 has a first diameter disposed proximate the first shaft end 82 and a second diameter disposed proximate the second shaft end 84 that is greater than the first diameter.

The exhaust port 94 is disposed proximate the first shaft end 82. The exhaust port 94 extends into the bore 92.

The rotor 24 is disposed within the first housing 40. The rotor 24 is rotatably connected to the shaft assembly 22. The rotor 24 is disposed about the shaft body 80 proximate the first shaft end 82. The rotor 24 includes a fan blade 100 and a shroud 102. The fan blade 100 extends towards an inner surface of the first housing 40. The shroud 102 is operatively connected to the rotor 24 and the shaft assembly 22. The shroud 102 defines at least one opening.

The motor housing 26 is disposed within the cavity 46 and extends between the first housing 40 and the second housing 42 of the housing assembly 20. The motor housing 26 is configured to receive a motor that is configured to drive the rotor 24 to rotate the fan blade 100. The motor housing 26 is spaced apart from the rotor 24.

The motor housing 26 includes a mounting portion 110, a housing extension 112, and a vane platform 114. The mounting portion 110 is disposed about the shaft body 80 of the shaft assembly 22. The mounting portion 110 includes a first leg 120, a second leg 122, and an arm 124. The first leg 120 is disposed substantially perpendicular and extends towards to the axis 70. The second leg 122 extends from the first leg 120. The second leg 122 is disposed substantially parallel to the axis 70. The arm 124 extends from the second leg 122 towards the housing extension 112. The housing extension 112 extends from the arm 124 of the mounting portion 110. The housing extension 112 is disposed substantially parallel to the axis 70 and is disposed substantially parallel to the second leg 122. The vane platform 114 extends from the housing extension 112. At least a portion of the vane platform 114 is disposed substantially parallel to the axis 70 and is disposed substantially parallel to the housing extension 112.

The vane platform 114 includes a stator or a vane 130. The vane 130 extends between the vane platform 114 and an inner surface of the second housing 42.

The bearing housing 28 is operatively connected to the motor housing 26. The bearing housing 28 includes a bearing arm 140, a bearing leg 142, and a bearing extension 144. The bearing arm 140 is disposed about the shaft body 80 and is disposed proximate the second shaft end 84. The bearing arm 140 is disposed substantially parallel to the axis 70. The bearing leg 142 extends from the bearing arm 140. The bearing leg 142 is disposed substantially perpendicular to the axis 70 and the bearing arm 140. At least a portion of the bearing leg 142 extends towards the axis 70. The bearing leg 142 of the bearing housing 28 defines a bearing opening 146. The bearing extension 144 extends from the bearing leg 142 towards the motor housing 26. The bearing extension 144 is operatively connected to at least one of the housing extension 112 and the vane platform 114. The bearing extension 144 is disposed substantially parallel to the axis 70.

The thrust plate 30 is positioned axially between the rotor 24 and the motor housing 26. The thrust plate 30 is disposed between the mounting portion 110 and the shaft assembly 22. The thrust plate 30 is disposed between the mounting portion 110 and a motor mount 150.

The hybrid bearing system 32 includes a rotating element bearing 160 and an air bearing 162. The rotating element bearing 160 is disposed about the shaft body 80 proximate the first shaft end 82 of the shaft assembly 22. The rotating element bearing 160 is disposed between the thrust plate 30 and the shaft assembly 22. The rotating element bearing 160 is configured as a roller bearing that includes a plurality of rolling elements such as balls, cones, rollers, or the like that are disposed between an inner race and an outer race. The rotating element bearing 160 may also be configured as a radial and thrust ball bearing. The rotating element bearing 160 is configured to rotatably support the first shaft end 82 of the shaft assembly 22.

The air bearing 162 is disposed about the shaft body 80 proximate the second shaft end 84. The air bearing 162 is disposed between the bearing arm 140 and the shaft assembly 22. The air bearing 162 may be configured as a thin film hydrodynamic foil bearings that rotatably supports rotating components of the ventilation fan 10 such as the second shaft end 84 of the shaft assembly 22.

An inner surface of the air bearing 162 and an outer surface of the shaft body 80 proximate the second shaft end at 84 define an air bearing flow path 164. The bearing opening 146 is in fluid communication with the air bearing flow path 164, the first port 90, the bore 92, and the exhaust port 94 to define an air flow path 166. The air flow path 166 is illustrated by the block arrows shown in FIG. 2. Airflow that flows through the air flow path hundred and 66 is exhausted through the opening of the shroud 102.

Figure 3:
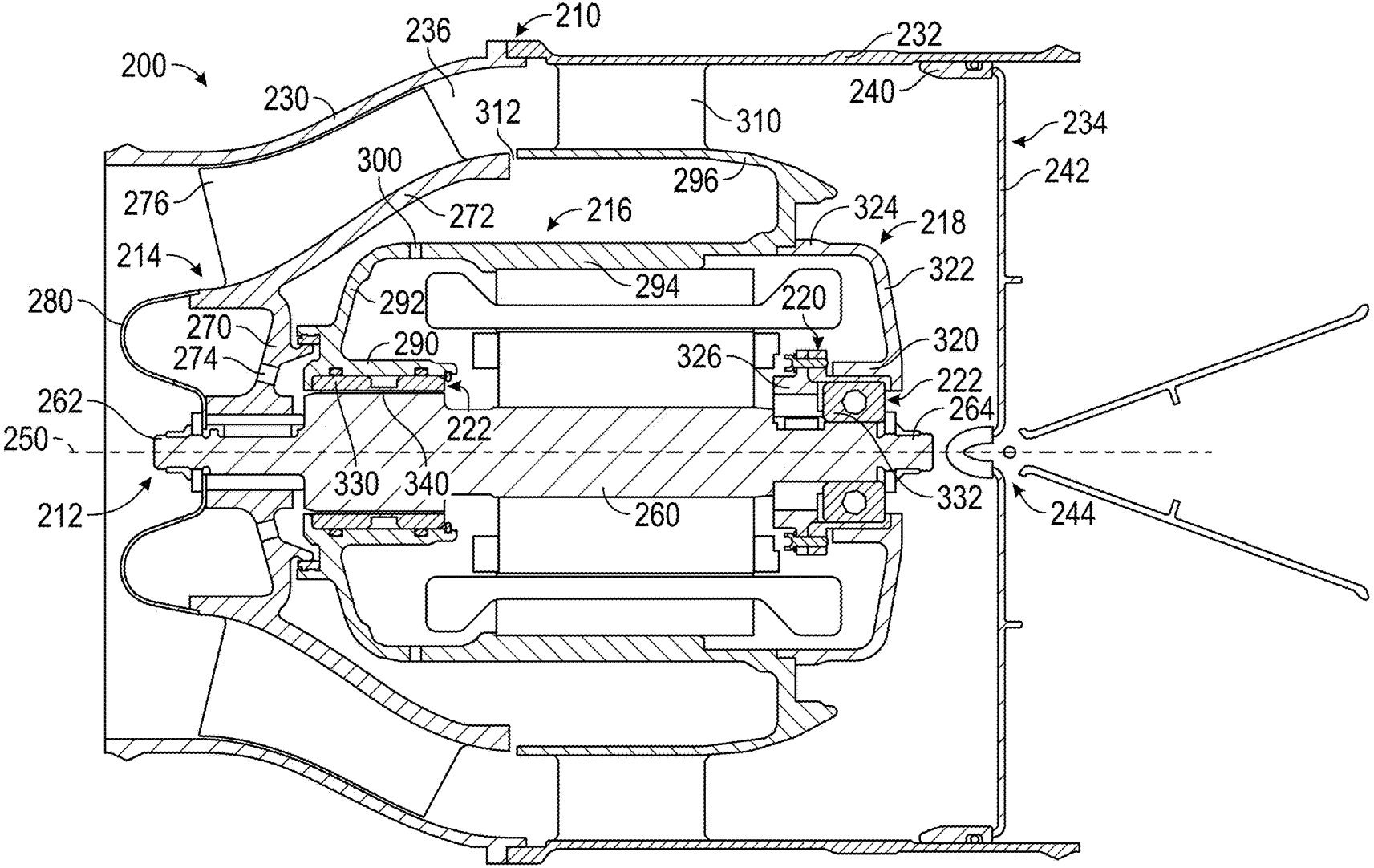
FIG. 3 is a sectional view of a second embodiment of a ventilation fan having a hybrid bearing system.
Figure 4:
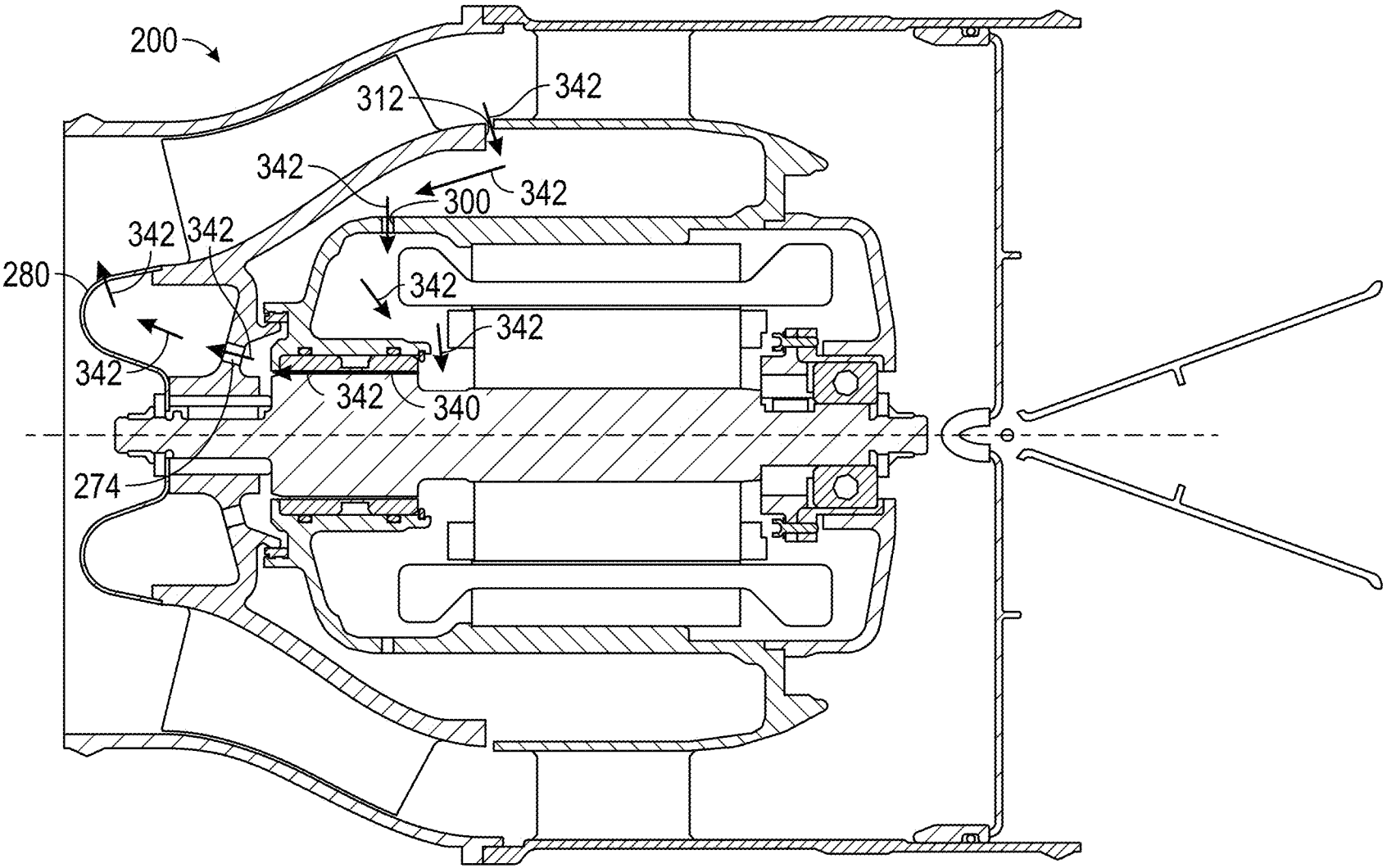
FIG. 4 is a sectional view of the second embodiment of the ventilation fan illustrating flow paths of the hybrid bearing system.

Referring to FIGS. 3 and 4, a second embodiment of a ventilation fan 200 is illustrated. The ventilation fan 200 includes a housing assembly 210, a shaft assembly 212, a rotor 214, a motor housing 216, a bearing housing 218, a thrust plate 220, and a hybrid bearing system 222.

The housing assembly 210 includes a first housing 230 that is operatively connected to a second housing 232 and a check valve assembly 234 that is operatively connected to the second housing 232. The first housing 230 and the second housing 232 cooperate to define a cavity 236 that may receive various components of the ventilation fan 200. The first housing 230 and the second housing 232 have a substantially similar configuration to the first housing 40 and the second housing 42 as shown in FIGS. 1 and 2.

The check valve assembly 234 is disposed proximate an end of the second housing 232. The check valve assembly 234 includes a mounting frame 240, a valve plate 242, and a valve mechanism 244. The mounting frame 240 is disposed on an interior surface of the second housing 232. The valve plate 242 is operatively connected to the second housing 232 via the mounting frame 240. The valve plate 242 defines an opening that is configured to receive the valve mechanism 244. The valve mechanism 244 is configured as a one-way valve to inhibit backflow through the ventilation fan 200.

The shaft assembly 212 is disposed within the cavity 236 of the housing assembly 210. The shaft assembly 212 extends along an axis 250. The shaft assembly 212 includes a shaft body 260 that extends between a first shaft end 262 and the second shaft end 264. The shaft body 260 may be a solid body. The first shaft end 262 has a first shaft end diameter and the second shaft end 264 has a second shaft end diameter that is less than the first shaft end diameter.

The rotor 214 is disposed within the first housing 230. The rotor 214 is rotatably connected to the shaft assembly 212. The rotor 214 includes a rotor first portion 270 and a rotor second portion 272. The rotor first portion 270 is disposed about the shaft body 260 proximate the first shaft end 262. The rotor first portion 270 defines a rotor port 274 that extends completely through the rotor first portion 270. The rotor second portion 272 extends from the rotor first portion 270. The rotor second portion 272 includes a fan blade 276. The fan blade 276 extends towards an inner surface of the first housing 230.

In at least one embodiment, the rotor 214 includes a shroud 280. The shroud 280 is operatively connected to the rotor first portion 270 and the shaft body 260. The shroud 280 defines at least one opening.

The motor housing 216 includes a housing arm 290, a housing leg 292, a housing extension 294, and a vane platform 296. The housing arm 290 is disposed about the shaft body 80 proximate the first shaft end 262. The housing arm 290 is disposed substantially parallel to the axis 250. The housing leg 292 extends from the housing arm 290. The housing extension 294 extends from the housing leg 292. The housing extension 294 is disposed substantially parallel to the axis 250 and is disposed substantially parallel to the housing arm 290. The housing extension 294 is radially spaced apart from the housing arm 290. The housing extension 294 defines a housing port 300 that extends completely through the housing extension 294.

The vane platform 296 extends from the housing extension 294. At least a portion of the vane platform 296 is disposed substantially parallel to the axis 250 and is disposed substantially parallel to the housing extension 294 and the housing arm 290.

The vane platform 296 includes a stator or a vane 310 that extends between the vane platform 296 and an inner surface of the second housing 232. A first opening 312 is defined between respective ends of the rotor second portion 272 and the vane platform 296.

The bearing housing 218 is operatively connected to the motor housing 216. The bearing housing 218 includes a bearing arm 320, a bearing leg 322, and a bearing extension 324. The bearing arm 320 is disposed about the shaft body 260 proximate the second shaft end 264. The bearing arm 320 is disposed substantially parallel to the axis 250. The bearing leg 322 extends from the bearing arm 320. The bearing leg 322 is disposed substantially perpendicular to the axis 250 and the bearing arm 320. At least a portion of the bearing leg 322 extends towards the axis 250. The bearing extension 324 extends from the bearing leg 322 towards the motor housing 26. The bearing extension 324 is operatively connected to at least one of the housing extension 294 and the vane platform 296. The bearing extension 324 is disposed substantially parallel to the axis 250.

The thrust plate 220 is disposed between the bearing arm 320 and the shaft body 260 proximate the second shaft end 264. The thrust plate 220 is disposed between the bearing leg 322 and a motor mount 326.

The hybrid bearing system 222 includes an air bearing 330 and a rotating element bearing 332. The air bearing 330 is disposed about the shaft body 260 proximate the first shaft end 262. The air bearing 330 is disposed between the housing arm 290 and the shaft assembly 212. The air bearing 330 may be configured as a thin film hydrodynamic foil bearings that rotatably supports rotating components of the ventilation fan 200 such as the first shaft end 262 of the shaft assembly 212.

An inner surface of the air bearing 330 and an outer surface of the shaft body 260 proximate the first shaft end 262 define an air bearing flow path 340. The first opening 312 is in fluid communication with the housing port 300, the air bearing flow path 340, and the rotor port 274 to define a flow path 342. The flow path 342 is illustrated by the solid block arrows shown in FIG. 4. Airflow that flows through the flow path 342 is exhausted through an opening of the shroud 280.

The rotating element bearing 332 is disposed about the shaft body 80 proximate the second shaft end 264. The rotating element bearing 332 is disposed between the thrust plate 220 and the shaft assembly 212. The rotating element bearing 332 is configured as a roller bearing that includes a plurality of rolling elements such as balls, cones, rollers, or the like that are disposed between an inner race and an outer race. The rotating element bearing 332 may also be configured as a radial and thrust ball bearing. The rotating element bearing 332 is configured to rotatably support the second shaft end 264 of the shaft assembly 212.

Figure 5:
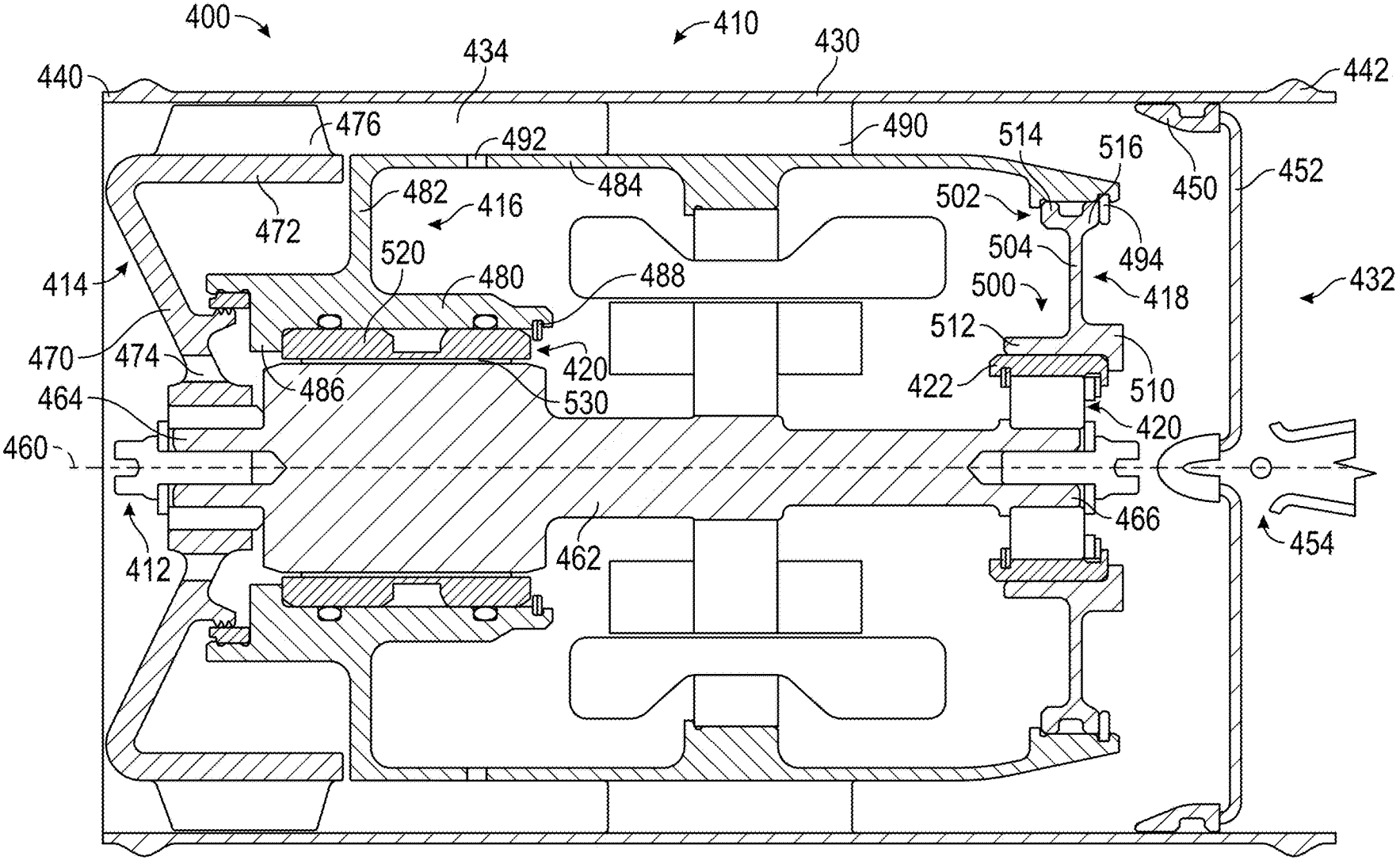
FIG. 5 is a sectional view of a third embodiment of a ventilation fan having a hybrid bearing system.
Figure 6:
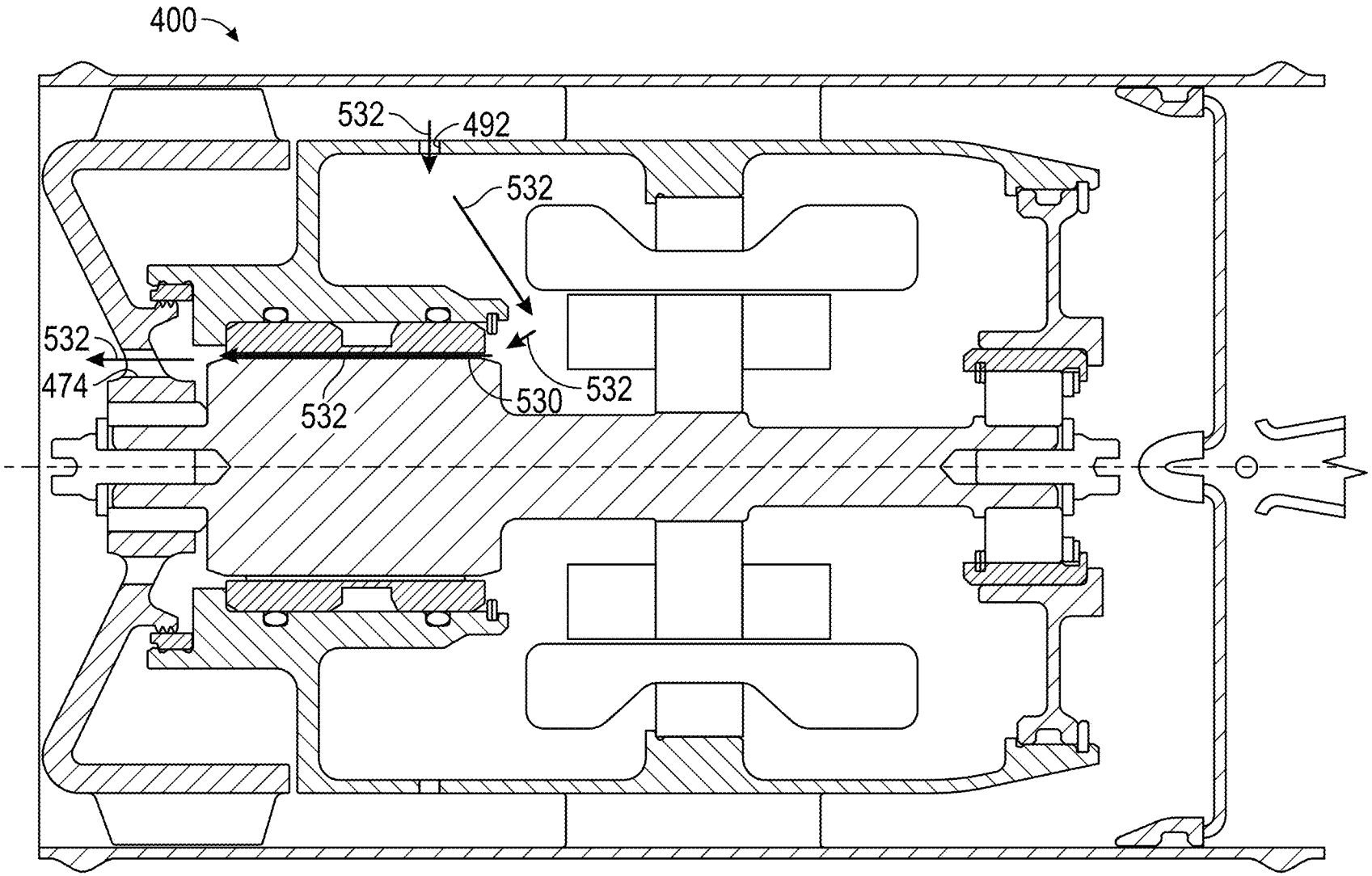
FIG. 6 is a sectional view of the third embodiment of the ventilation fan illustrating flow paths of the hybrid bearing system.

Referring to FIGS. 5 and 6, a third embodiment of a ventilation fan 400 is illustrated. The ventilation fan 400 includes a housing assembly 410, a shaft assembly 412, a rotor 414, a motor housing 416, a bearing housing 418, and a hybrid bearing system 420.

The housing assembly 410 includes a housing body 430 and a check valve assembly 432 that is operatively connected to the housing body 430. The housing body 430 defines a cavity 434 that may receive various components of the ventilation fan 400.

The housing body 430 defines a fan section inlet at a first end 440 of the housing body 430 and a fan section outlet at a second end 442 of the housing body 430. The first end 440 may have a first diameter and the second end 442 may have a second diameter that is substantially equal to the first diameter.

The check valve assembly 432 is disposed proximate the second end 442 of the housing body 430. The check valve assembly 432 includes a mounting frame 450, a valve plate 452, and a valve mechanism 454. The mounting frame 450 is disposed on an interior surface of the housing body 430. The valve plate 452 is operatively connected to the housing body 430 via the mounting frame 450. The valve plate 452 defines an opening that is configured to receive the valve mechanism 454. The valve mechanism 454 is configured as a one-way valve to inhibit backflow through the ventilation fan 400.

The shaft assembly 412 is disposed within the cavity 434 of the housing assembly 410. The shaft assembly 412 extends along an axis 460. The shaft assembly 412 includes a shaft body 462 that extends between a first shaft end 464 and a second shaft end 466.

The rotor 414 is disposed within the cavity 434 of the housing body 430. The rotor 214 is rotatably connected to the shaft assembly 412. The rotor 414 includes a rotor first portion 470 and a rotor second portion 472. The rotor first portion 470 is disposed about the shaft body 462 proximate the first shaft end 464. The rotor first portion 470 defines a rotor port 474 that extends completely through the rotor first portion 470. The rotor second portion 472 extends from the rotor first portion 470 towards an inner surface of the housing body 430. The rotor second portion 472 includes a fan blade 476. The fan blade 476 extends towards the inner surface of the housing body 430.

The motor housing 416 is disposed within the cavity 434 of the housing assembly 410. The motor housing 416 is configured to receive a motor that is configured to drive the rotor 414 to rotate the fan blade 476. The motor housing 416 is spaced apart from the rotor 414.

The motor housing 416 includes a housing arm 480, a housing leg 482, and a vane platform 484. The housing arm 480 is disposed about shaft body 462 proximate the first shaft end 464. The housing arm 480 is disposed substantially parallel to the axis 460. The housing arm 480 includes a first retaining feature 486 and the second retaining feature 488 that is spaced apart from the first retaining feature 486. The first retaining feature 486 and the second retaining feature 488 extends from the housing arm 480 towards the axis 460. The first retaining feature 486 is configured as an integral extension of the housing arm 480 that is disposed substantially perpendicular to the housing arm 480. The second retaining feature 488 is configured as a tab that is received within a slot formed in an inner surface of the housing arm 480.

The housing leg 482 extends from the housing arm 480. The housing leg 482 is disposed substantially perpendicular to the axis 460. The vane platform 484 extends from the housing leg 482. At least a portion of the vane platform 484 is disposed substantially parallel to the axis 460 and is disposed substantially parallel to the housing arm 480.

The vane platform 484 includes a stator or a vane 490 that extends between the vane platform 484 and an inner surface of the housing body 430. The vane platform 484 defines a housing port 492 that extends completely through the vane platform 484. The housing port 492 extends along an axis that is disposed substantially perpendicular to the axis 460. The vane platform 484 further includes a retainer 494 that extends from an inner surface of the vane platform 484 towards the axis 460. The retainer 494 is configured as a tab that is received within a slot formed within the inner surface of the vane platform 484.

The bearing housing 418 extends between the vane platform 484 of the motor housing 416 and the shaft assembly 412. The bearing housing 418 is disposed about the shaft body 362 proximate the second shaft end 366.

The bearing housing 418 includes a first portion 500, a second portion 502, and an extension portion 504. The first portion 500 is configured to engage at least a portion of the hybrid bearing system 420. The first portion 500 includes a first leg 510 and a second leg 512. The first leg 510 is disposed substantially perpendicular to the axis 460. The second leg 512 extends from the first leg 510 and is disposed substantially parallel to the axis 460. The second leg 512 is disposed into perpendicular to the first leg 510.

The second portion 502 is configured to engage the vane platform 484. The second portion 502 includes a first arm 514 and a second arm 516. The first arm 514 and the second arm 516 are disposed substantially perpendicular to the axis 460. The first arm 514 is disposed substantially parallel to the second arm 516. The first arm 514 and the second arm 516 engage an inner surface of the vane platform 484. The second arm 516 is configured to engage the retainer 494.

The extension portion 504 extends between the first portion 500 and the second portion 502. The extension portion 504 is disposed substantially perpendicular to the axis 460.

The hybrid bearing system 420 includes an air bearing 520 and a rotating element bearing 522. The air bearing 520 is disposed about the shaft body 462 and is disposed proximate the first shaft end 464. The air bearing 520 is disposed between the housing arm 480 and the shaft assembly 412. The air bearing 520 is disposed between the first retaining feature 486 and the second retaining feature 488. The air bearing 520 may be configured as a thin film hydrodynamic foil bearings that rotatably supports rotating components of the ventilation fan 400 such as the first shaft end 464 of the shaft assembly 412.

An inner surface of the air bearing 520 and an outer surface of the shaft body 462 proximate the first shaft end 464 define an air bearing flow path 530. The housing port 492 is in fluid communication with the air bearing flow path 530 and the rotor port 474 to define a flow path 532. The flow path 532 is illustrated by the solid block arrows shown in FIG. 6.

The rotating element bearing 522 is disposed about the shaft body 362 proximate the second shaft end 366. The rotating element bearing 522 is disposed between the first portion 500 and the shaft assembly 412. The rotating element bearing 522 is configured as a roller bearing that includes a plurality of rolling elements such as balls, cones, rollers, or the like that are disposed between an inner race and an outer race. The rotating element bearing 522 may also be configured as a radial and thrust ball bearing. The rotating element bearing 522 is configured to rotatably support the second shaft end 366 of the shaft assembly 412.

Throughout this specification, the term "attach," "attachment," "connected", "coupled," "coupling," "mount," or "mounting" shall be interpreted to mean that a structural component or element is in some manner connected to or contacts another element, either directly or indirectly through at least one intervening structural element, or is integrally formed with the other structural element.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the scope of the present disclosure. Additionally, while various embodiments of the present disclosure have been described, it is to be understood that aspects of the present disclosure may include only some of the described embodiments or combinations of the described embodiments. Accordingly, the present disclosure is not to be seen as limited by the foregoing description, but is only limited by the scope of the appended claims.

What is claimed is:

1. A ventilation fan, comprising:

a shaft having a shaft body extending axially between a first shaft end and a second shaft end;

a rotor having a rotor first portion disposed about the shaft and disposed proximate the first shaft end and a rotor second portion extending from the rotor first portion, the rotor first portion defining a rotor port;

a motor housing disposed about the shaft body and axially spaced apart from the rotor, the motor housing having: an axially extending housing arm that extends axially; a housing leg extending radially from the housing arm; a housing extension extending axially from the housing leg, wherein the housing extension is radially spaced apart from the housing arm and the housing extension defines a housing port proximate the housing leg and a vane platform extending axially from the housing extension, wherein the vane platform is radially spaced apart from the housing extension;

a first opening being defined between respective ends of the rotor second portion and the vane platform; and a bearing housing disposed about the shaft body and disposed proximate the second shaft end, the bearing housing having: a bearing arm that extends axially; a bearing leg extending radially from the bearing arm; and a bearing extension extending axially from the bearing leg and operatively connected to the housing extension, wherein:

an air bearing is disposed proximate the first shaft end and disposed radially between the housing arm and the shaft body;

an inner surface of the air bearing and an outer surface of the shaft body define an air bearing flow path; and the first opening is in fluid communication with the housing port, the air bearing flow path, and the rotor port to define an air flow path.

2. The ventilation fan of claim 1, further comprising:

a rotating element bearing that rotatably supports the shaft body and is disposed proximate the second shaft end.

3. The ventilation fan of claim 2, further comprising:

a thrust plate disposed between the bearing arm and the rotating element bearing.

* * * * *